US011255070B2

(12) United States Patent
Agnew et al.

(10) Patent No.: US 11,255,070 B2
(45) Date of Patent: Feb. 22, 2022

(54) HYDRAULIC COUPLING

(71) Applicant: Clark Equipment Company, West Fargo, ND (US)

(72) Inventors: Dennis Agnew, Moffit, ND (US); Brent C. Durkin, Bismarck, ND (US); Caren A. Loebs, Bismarck, ND (US); Daniel J. Krieger, Bismarck, ND (US)

(73) Assignee: Clark Equipment Company, West Fargo, ND (US)

( * ) Notice: Subject to any disclaimer, the term of this patent is extended or adjusted under 35 U.S.C. 154(b) by 296 days.

(21) Appl. No.: 16/443,372

(22) Filed: Jun. 17, 2019

(65) Prior Publication Data

US 2019/0382979 A1 Dec. 19, 2019

Related U.S. Application Data

(60) Provisional application No. 62/685,419, filed on Jun. 15, 2018.

(51) Int. Cl.

| | |
|---|---|
| ***E02F 3/36*** | (2006.01) |
| ***E02F 3/34*** | (2006.01) |
| *E02F 3/96* | (2006.01) |

(52) U.S. Cl.

CPC ..... *E02F 3/3663* (2013.01); *E02F 3/34* (2013.01); *E02F 3/3659* (2013.01); *E02F 3/96* (2013.01)

(58) Field of Classification Search

CPC ..... E02F 3/34; E02F 3/3654; E02F 3/3659; E02F 3/3663; E02F 3/96

(Continued)

(56) References Cited

U.S. PATENT DOCUMENTS 3,243,066 A * 3/1966 Gardner ..... E02F 3/3663 414/698
4,208,163 A * 6/1980 Holmqvist ..... E02F 3/3631 280/421

(Continued)

FOREIGN PATENT DOCUMENTS

DE 102005027807 A1 * 12/2006 ..... E02F 3/96
DE 102005027807 A1 12/2006

(Continued)

OTHER PUBLICATIONS

Meyer Runald, Machine Translation of DE-102005027807-A1, Espacenet (Year: 2006).*

(Continued)

*Primary Examiner* — Saul Rodriguez
*Assistant Examiner* — Brendan P Tighe
(74) *Attorney, Agent, or Firm* — John Veldhuis-Kroeze; Westman, Champlin & Koehler, P.A.

(57) ABSTRACT

Disclosed embodiments include power machines, implement coupling systems and methods in which hydraulic or electric coupling between an implement and the power machine is made automatically using an existing actuator, for example a tilt actuator, of the power machine. Thus, additional actuators are not required to achieve hydraulic or electric coupling. In exemplary embodiments, power coupling is also free from the process of mechanically coupling the implement to the implement carrier. Also, in exemplary embodiments, a machine side coupler assembly moves with the implement after a connection is established, despite the implement coupler assembly being removed from the implement carrier. This allows the same implement carrier to be used on all similarly sized machines.

24 Claims, 12 Drawing Sheets

(58) Field of Classification Search
USPC ..... 414/723
See application file for complete search history.

(56) References Cited

U.S. PATENT DOCUMENTS

| | | | | |
|---|---|---|---|---|
| 4,371,004 | A | 2/1983 | Sysolin et al. | |
| 4,738,463 | A * | 4/1988 | Poore | A01B 59/062 280/420 |
| 4,955,779 | A | 9/1990 | Knackstedt | |
| 5,108,252 | A | 4/1992 | Gilmore, Jr. et al. | |
| 5,199,844 | A | 4/1993 | Gilmore, Jr. et al. | |
| 5,333,400 | A | 8/1994 | Sonerud | |
| 5,360,313 | A | 11/1994 | Gilmore, Jr. et al. | |
| 5,465,513 | A | 11/1995 | Sonerud | |
| 5,484,250 | A | 1/1996 | Gilmore, Jr. et al. | |
| 6,196,595 | B1 * | 3/2001 | Sonerud | E02F 3/3631 285/26 |
| 6,301,811 | B1 | 10/2001 | Gilmore, Jr. | |
| 6,428,265 | B1 | 8/2002 | Gilmore, Jr. | |
| 6,813,851 | B2 | 11/2004 | Mieger et al. | |
| 6,899,509 | B1 | 5/2005 | Mailleux | |
| 7,246,457 | B2 | 7/2007 | Mieger et al. | |
| 7,290,977 | B2 | 11/2007 | Albright et al. | |
| 7,464,967 | B2 | 12/2008 | Mieger et al. | |
| 7,686,563 | B2 * | 3/2010 | Frey | E02F 9/2271 414/723 |
| 7,686,567 | B2 | 3/2010 | Grover et al. | |
| 7,963,054 | B2 * | 6/2011 | Wimmer | E02F 3/3663 37/468 |
| 9,357,690 | B2 | 6/2016 | Huegerich et al. | |
| 9,375,988 | B2 * | 6/2016 | Huegerich | B60D 1/62 |
| 9,377,146 | B2 | 6/2016 | Van Hooft et al. | |
| 9,404,235 | B2 | 8/2016 | Van Hooft et al. | |
| 9,512,597 | B2 | 12/2016 | Van Hooft et al. | |
| 9,546,469 | B2 | 1/2017 | Van Hooft et al. | |
| 9,670,642 | B2 | 6/2017 | Pesch et al. | |
| 9,873,998 | B2 | 1/2018 | Otto et al. | |
| 2002/0127090 | A1 * | 9/2002 | Dick | E02F 3/3668 414/723 |
| 2011/0262212 | A1 | 10/2011 | Luyendijk et al. | |
| 2012/0306195 | A1 | 12/2012 | Fowkes et al. | |
| 2013/0181150 | A1 | 6/2013 | Van Hooft et al. | |
| 2013/0199644 | A1 | 8/2013 | Van Hooft et al. | |
| 2015/0275466 | A1 | 10/2015 | Behr et al. | |

FOREIGN PATENT DOCUMENTS

| | | | |
|---|---|---|---|
| DE | 202016005365 | U1 | 10/2016 |
| EP | 1365074 | A1 | 11/2003 |
| GB | 2310472 | A | 8/1997 |
| WO | 2015/090587 | A1 | 6/2015 |
| WO | 2016/107703 | A1 | 7/2016 |

OTHER PUBLICATIONS

International Search Report and Written Opinion dated Sep. 27, 2019 for International Application No. PCT/US2019/037512 filed Jun. 17, 2019, 13 pages.

* cited by examiner

HYDRAULIC COUPLING

CROSS-REFERENCE TO RELATED APPLICATION

This application claims the benefit of U.S. Provisional Application No. 62/685,419, which was filed on Jun. 15, 2018.

BACKGROUND

This present disclosure is related to hydraulic coupling of an implement with a power machine. More particularly, the present disclosure is related to a system that allows for an automated coupling and uncoupling of an implement with a power machine.

Power machines, for the purposes of this disclosure, include any type of machine that generates power for accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Some examples of work vehicle power machines include loaders, excavators, utility vehicles, tractors, and trenchers, to name a few.

Some power machines can be operably coupled to implements that are capable of cooperating with the power machine to perform various tasks. For example, some loaders have lift arms that can have a wide variety of implements operably coupled to them, ranging from a simple bucket or blade to relatively complex implements such as planers and graders that have work devices capable of performing various tasks. Some of these work devices on implements are controllable by operator input devices on the power machines to which they are operably coupled.

Many power machines of this type can provide power and/or control signals to an operably coupled implement. Thus, when a power machine is operably coupled to an implement, a connection is made between one or more power and/or control signal sources on the power machine and the implement. A common type of power source on such types of power machines is a hydraulic power source. Pressurized hydraulic fluid is selectively provided from the power machine to the implement once the connection is made. To connect and disconnect an implement from a power machine, the hydraulic connections between the machine and implement must be physically made and broken. Another type of power source on such types of power machines is electric power. Electrical signals can be provided from a power machine to an implement to provide power for and/or control of functions on the implement Like hydraulic signals, most electrical signals are provided through connections that are made between the power machine and the implement.

The discussion above is merely provided for general background information and is not intended to be used as an aid in determining the scope of the claimed subject matter.

SUMMARY

This Summary and the Abstract are provided to introduce a selection of concepts in a simplified form that are further described below in the Detailed Description. The summary and the abstract are not intended to identify key features or essential features of the claimed subject matter.

The present disclosure includes power machines and implement coupling systems in which hydraulic coupling between an implement and the power machine is made automatically using an existing actuator, for example a tilt actuator, of the power machine. Thus, additional actuators are not required to achieve hydraulic coupling. In exemplary embodiments, hydraulic coupling is also free from the process of mechanically coupling the implement to the implement carrier. Also, in exemplary embodiments, a machine side coupler assembly moves with the implement after a hydraulic connection is established, despite the implement couplers being removed from the implement carrier. This allows the same implement carrier to be used on all similarly sized machines.

In some exemplary embodiments, a power machine (100, 200, 300, 400, 400-1) is provided, with the power machine configured to accept and removably secure an implement (275, 375) to the power machine. The power machine has a power source (120, 220, 492) configured to selectively provide power to the implement once the implement is secured to the power machine. In exemplary embodiments, the power machine includes a structural member (230, 330, 430) and an implement carrier (272, 372, 472) pivotably mounted about an axis (274, 374, 474) to the structural member and configured to removably mount the implement to the structural member. The power machine also includes a first coupler assembly (285, 385, 485) pivotably coupled to the structural member and configured to pivot about the axis (274, 347, 474) relative to the structural member and relative to the implement carrier. The first coupler assembly is configured to be coupled to the implement to provide power to the implement.

In some exemplary embodiments, the power machine further includes a tilt actuator (280, 380, 480), coupled to the implement carrier and configured to pivot the implement carrier about the axis.

In some exemplary embodiments, the power machine further comprises a biasing mechanism (290, 390) configured to bias the first coupler assembly toward a resting position when the first coupler assembly is not coupled to the implement and allow pivotal movement of the first coupler assembly relative to the structural member when the first coupler assembly is coupled to the implement. In some embodiments, the biasing mechanism is configured to bias the first coupler assembly away from the implement carrier.

In some exemplary embodiments, the power machine further includes a stop (389) mounted on the power machine and so disposed and arranged as to prevent the first coupler assembly from being rotated by the biasing mechanism beyond the resting position.

In some exemplary embodiments, the structural member (230, 330, 430) includes a lift arm assembly of the power machine. The lift arm assembly can include a pair of lift arms, and in some exemplary embodiments the first coupler assembly is positioned outside of one of the pair of lift arms. In other exemplary embodiments, the first coupler is positioned between the pair of lift arms.

In some exemplary embodiments, the structural member comprises a frame (110, 210) of the power machine.

In some exemplary embodiments, the first coupler assembly is pivotally mounted to the structural member and so disposed and arranged such that the implement mounted on the implement carrier is coupled to the first coupler assembly to receive power from the power machine by actuating the tilt actuator and rolling back the implement carrier until the implement engages the first coupler assembly.

In some exemplary embodiments, the first coupler assembly is a hydraulic coupler assembly providing hydraulic fluid under power to the implement. In some exemplary embodiments, the first coupler assembly is an electric coupler assembly providing electric power to the implement. The first coupler assembly is both a hydraulic coupler assembly and an electric coupler assembly in some embodiments.

In some exemplary embodiments, the power machine further includes a first mounting member (387, 487) having the first coupler assembly mounted thereon and being pivotably coupled to the structural member to provide the pivotable coupling of the first coupler assembly to the structural member. A second coupler assembly (377, 577) is coupled to the implement carrier in some embodiments and is configured to mate with the first coupler assembly.

In some exemplary embodiments, the power machine includes a release mechanism (295, 395) configured to cause the first coupler assembly to decouple from the implement. Further, in some exemplary embodiments, the power machine includes a release actuator (297, 397) operably coupled to the release mechanism and configured to cause the release mechanism to decouple the first coupler assembly from the implement.

In some exemplary embodiments, a method is provided of coupling a power supply (120, 220, 492) on a power machine (100, 200, 300, 400, 400-1) to an implement (275, 375). The method includes mounting the implement on an implement carrier (272, 372, 472) that is pivotably attached to the power machine. A tilt actuator (280, 380, 480) of the power machine is actuated, in accordance with the method, to rotate the implement carrier and mounted implement about an axis (274, 347, 474) until an implement coupler (377, 577) engages a machine coupler (285, 385, 485), with the machine coupler being pivotally attached to a structure (230, 330, 430) on the power machine and biased to a resting position.

In some exemplary embodiments of the method, mounting the implement on the implement carrier further comprise mounting the implement on the implement carrier that is pivotably attached to the structure on the power machine.

In some exemplary embodiments of the method, the structure on the power machine is a lift arm, and wherein mounting the implement on the implement carrier further comprise mounting the implement on the implement carrier that is pivotably attached to the lift arm of the power machine.

In some exemplary embodiments, the structure on the power machine is a frame of the power machine, and wherein mounting the implement on the implement carrier further comprise mounting the implement on the implement carrier that is pivotably attached to the frame of the power machine.

BRIEF DESCRIPTION OF THE DRAWINGS

FIGS. 11-1 through 11-3 are illustrations of an implement attachment interface.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

The present disclosure includes a system which makes and breaks power connections between an implement and a power machine after the implement is attached to an implement carrier of the power machine. These concepts can be practiced on various power machines, as will be described below. A representative power machine on which the embodiments can be practiced is illustrated in diagram form in FIG. 1, and portions of representative power machines are illustrated in FIGS. 2-11. Power machines, for the purposes of this discussion, include a frame, at least one work element, and a power source that is capable of providing power to the work element to accomplish a work task. One type of power machine is a loader.

Figure 1:
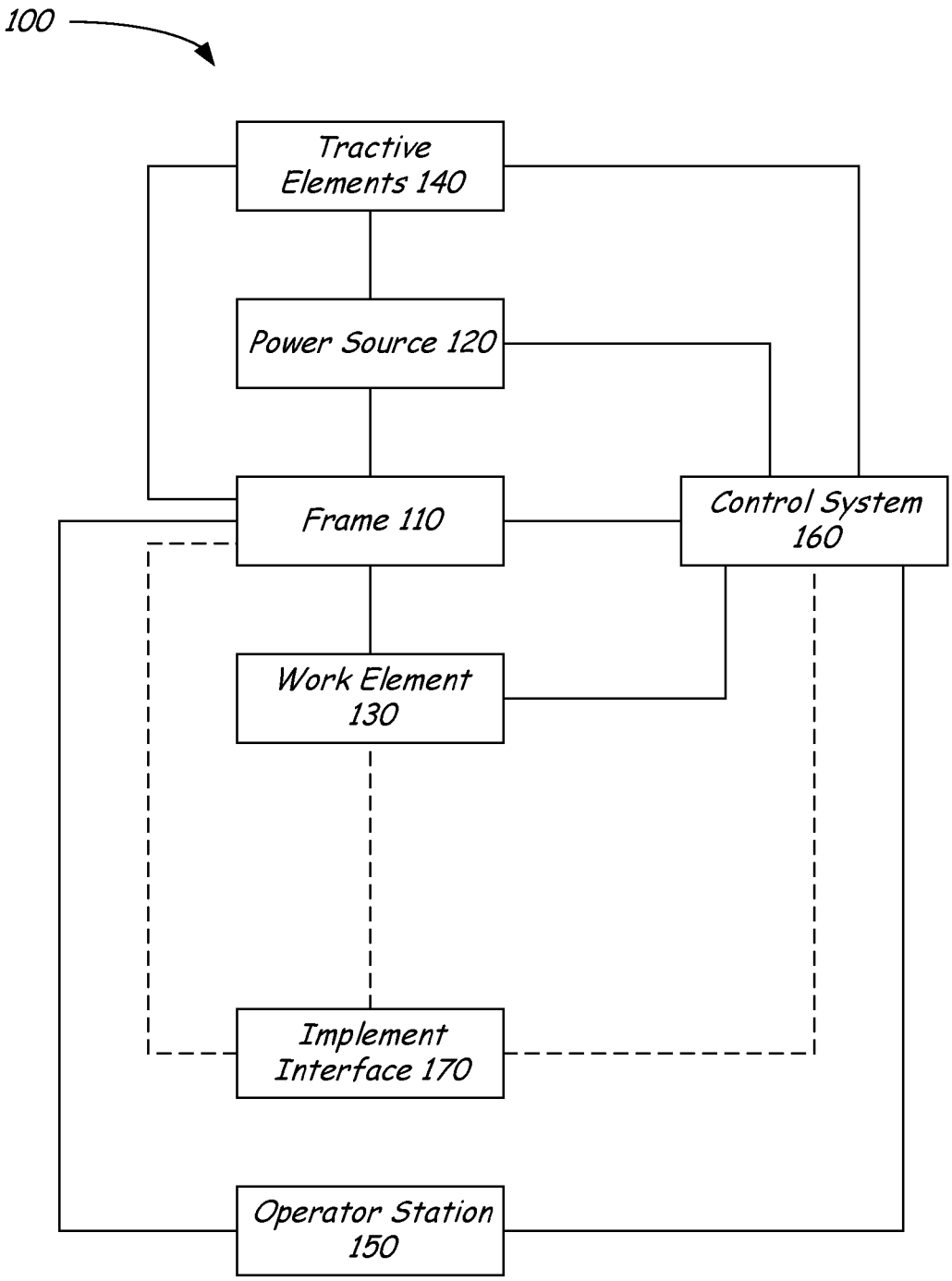
FIG. 1 is a block diagram illustrating functional systems of a representative power machine on which embodiments of the present disclosure can be advantageously practiced.

FIG. 1 illustrates a block diagram including the basic systems of a small loader type of power machine 100 upon which the embodiments discussed below can be advantageously incorporated. The block diagram of FIG. 1 identifies various systems on power machine 100 and the relationship between various components and systems. The power machine 100 has a frame 110, a power source 120, and a work element 130. Because power machine 100 shown in FIG. 1 can be a self-propelled power machine, it is also shown to have tractive elements 140, which are themselves work elements provided to move the power machine over a support surface and an operator station 150 that provides an operating position for controlling the work elements of the power machine. In exemplary embodiments described below in greater detail, operator station 150 can include a seat (not shown) and other features. A control system 160 is provided to interact with the other systems to perform various work tasks at least in part in response to control signals provided by an operator.

Certain power machines have work elements that are capable of performing a dedicated task. For example, some power machines have a lift arm to which an implement, such as a bucket, is attached such as by a pinning arrangement. The work element, i.e., the lift arm can be manipulated to position the implement for the purpose of performing the task. The implement, in some instances can be positioned relative to the work element, such as by rotating a bucket relative to a lift arm, to further position the implement. Under normal operation of such a power machine, the bucket is intended to be attached and under use. Such power machines may be able to accept other implements by disassembling the implement/work element combination and reassembling another implement in place of the original bucket. Other power machines, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a structural member, typically a work element 130 such as a lift arm, or to the frame 110. Implement interface 170 can also include one or more power sources for providing power to one or more work elements on an implement. Some power machines can have a plurality of work elements with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame.

Frame 110 supports the power source 120, which is capable of providing power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is capable of converting the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. Further, some power machines such as power machine 100 and others may be capable of being operated remotely (i.e. from a remotely located operator station) instead of or in addition to an operator station adjacent or on the power machine. This can include applications where at least some of the operator controlled functions of the power machine can be operated from an operating position associated with an implement that is coupled to the power machine. Alternatively, with some power machines, a remote-control device can be provided (i.e. remote from both of the power machine and any implement to which is it coupled) that is capable of controlling at least some of the operator controlled functions on the power machine.

Figure 2:
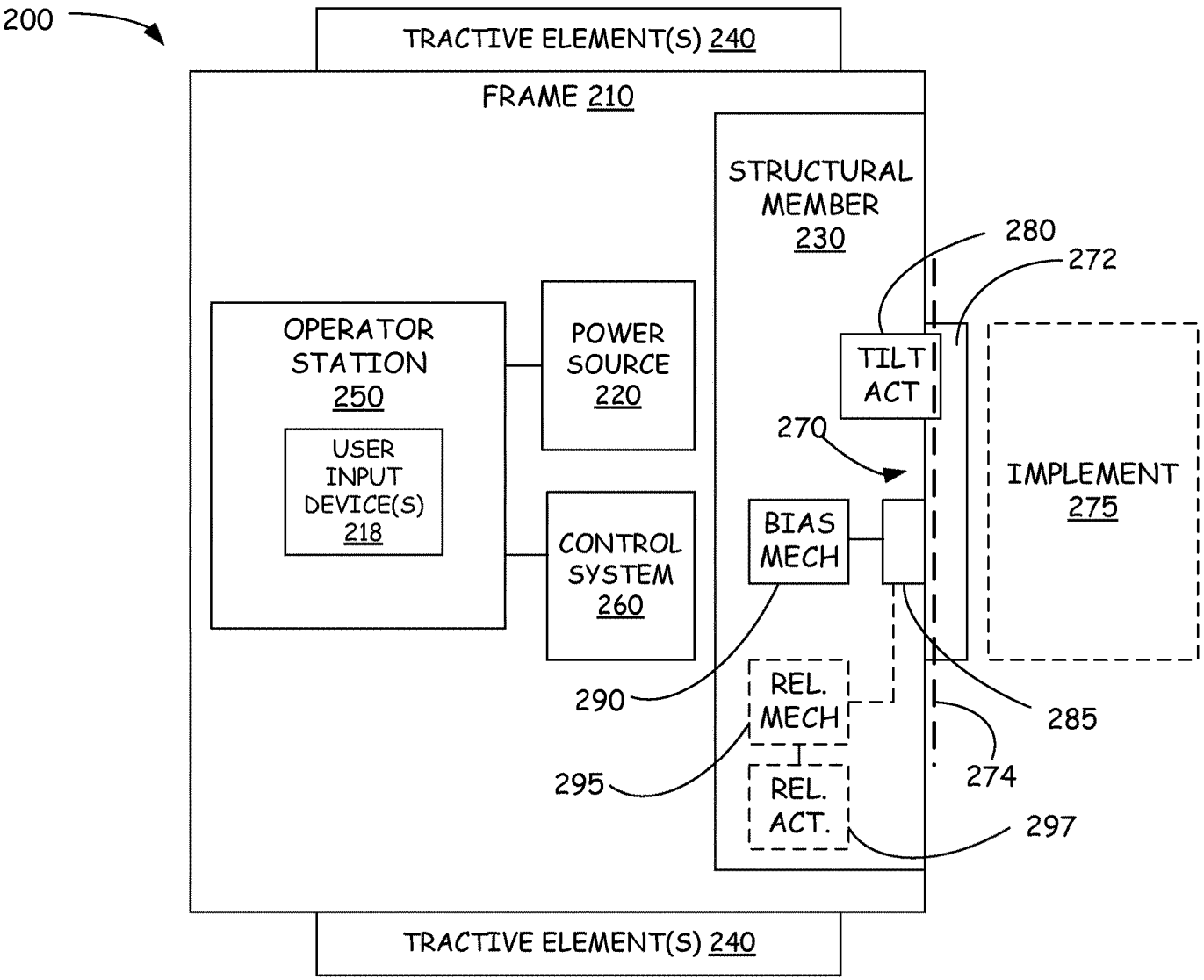
FIG. 2 is a more detailed exemplary embodiment of the power machine shown in FIG. 1, including additional features for facilitating coupling and decoupling of an implement to a power source on the power machine.

Referring now to FIG. 2, shown is a block diagram of portions of a power machine 200 in accordance with exemplary embodiments. Power machine 200 is of the type generally discussed above with respect to FIG. 1 and generally similar features are similarly numbered. For example, power machine 200 has a frame 210 to which a power source 220 is mounted. Tractive elements 240 are operably coupled on either side of the frame 210 and a structural member 230, such as a lift arm or other work element, is also coupled to the frame. In some embodiments, structural member 230 is itself a portion of the frame and is not a separate work element coupled to the frame. The structural member 230 has an implement interface 270 for accepting and securing an implement 275 thereto. Implement 275, which is representative of various types of implements, has an attachment interface 276, which is configured to engage and be attached to the implement interface 270 (and more particularly to an implement carrier 272, discussed below). The attachment interface 276 is rigidly secured to a tool portion 277, which is configured to perform a work function. On various implements, the tool portion can perform various functions, including work that is powered by hydraulic and/or electric actuators. A simple example of such a tool is a grapple bucket, with a hydraulically actuated grapple. A grapple bucket is an example of just one type of tool and the discussion of a grapple bucket is not intended, in any way, to limit the types of tools that can be used on implements that are coupled to a power machine in the embodiments discussed below. Other examples of tools include augers, planers, grinders, to name a few. As shown diagrammatically in FIG. 2, in some embodiments an operator station 250 is included with power machine 200 and is supported by frame 210. User input devices 218, for example included within operator station 250, can include, for example, levers, joysticks, buttons, rotary switches or devices, or other types of user input devices configured to control power machine and implement functions, through control system 260, such as work element functions, travel functions, and implement functions.

Power machine 200 includes components and features configured to accept and removably secure implement 275 to the power machine including coupling the implement 275 to the power source 220 such that a power signal can be selectively provided from power source 220 and/or control system 260 to implement 275. As shown in FIG. 2, implement interface 270 includes an implement carrier 272 that is pivotably mounted about an axis 274 to structural member 230. Implement carrier 272 is configured to removably mount implement 275 to structural member 230. As noted, structural member 230 can be a portion of frame 210, a lift arm, or other structural members of power machine 200. A tilt actuator 280 is coupled to the implement carrier 272 and is configured to pivot the implement carrier, about axis 274, relative to structural member 230. A first or machine side coupler assembly 285 is also pivotably coupled to structural member 230. In exemplary embodiments, first coupler assembly 285 is also pivotable about axis 274. In various embodiments, first coupler assembly 285 is a power coupler assembly configured to mate or connect to a second power coupler assembly on the implement carrier 272 or on the implement 275. The first and second coupler assemblies can be hydraulic coupler assemblies having hydraulic couplers connected through hydraulic hoses respectively to a hydraulic system on the power machine 200 and hydraulic actuators on the implement. Alternatively, or in addition, one or more couplers in each of the first and second coupler assemblies can be electrical coupler assemblies which are connected, through electrical cables or wires, respectively, to an electrical power source on the power machine and electrical actuators, controllers, etc. on the implement. Embodiments described below with reference to hydraulic couplers should be understood to include combined hydraulic and electrical couplers. Further, while the example embodiments are described with reference to hydraulic couplers, they are to be understood to include electrical couplers instead of hydraulic couplers in some embodiments.

Figure 5:
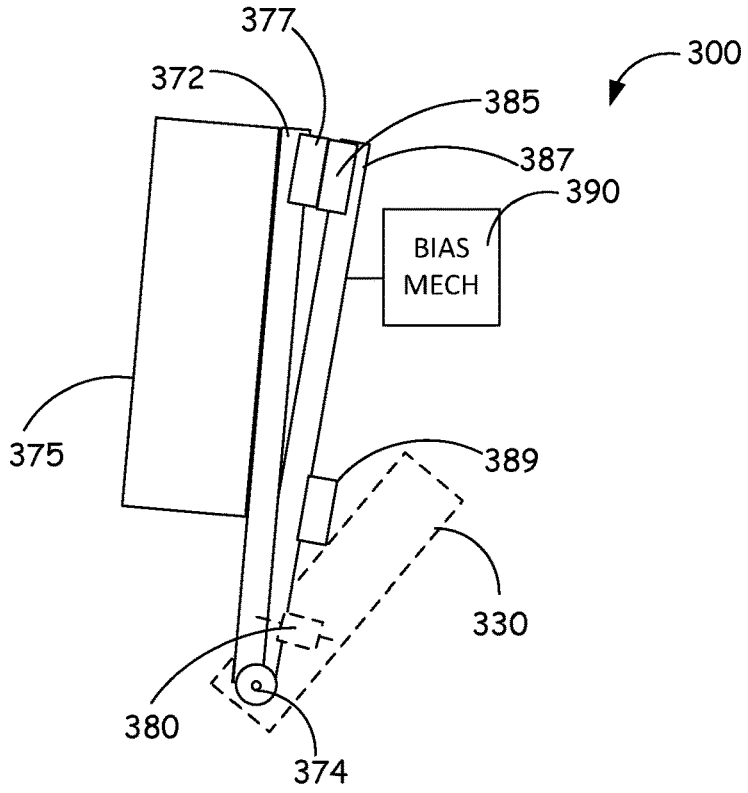
FIG. 5 is a diagrammatic illustration showing portions of the power machine as in FIGS. 3 and 4, with the implement carrier pivoted to establish a hydraulic coupling between the implement and the power machine.
Figure 6:
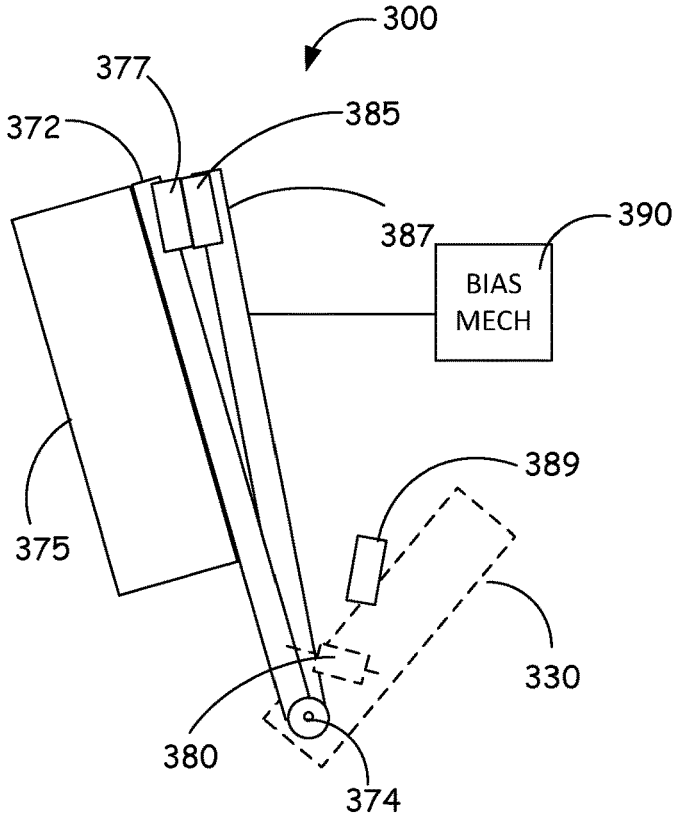
FIG. 6 is a diagrammatic illustration showing portions of the power machine as in FIGS. 3-5, with the first coupling assembly pivoted away from the resting position along with the implement carrier and implement.

A biasing mechanism 290 is coupled to first coupler assembly 285 or to supporting structures thereof in order to bias the first or machine side coupler assembly 285 to a resting position where the first coupler assembly is not coupled to implement 275, and allow pivotal movement of the first coupler assembly 285 relative to structural member 230 when the first coupler assembly is coupled to the implement 275 (e.g., shown in FIG. 6). As will be shown in the exemplary embodiments shown in FIGS. 3-7 and discussed below, power machine 200 can also include a stop mounted on the power machine and configured or arranged to prevent the first coupler assembly 285 from being rotated by the biasing mechanism 290 beyond its resting position.

In some embodiments, a first mounting member, such as a shaft, has the first hydraulic coupler assembly 285 mounted thereon and the first mounting member is pivotably coupled to the structural member 230 to provide the pivotable coupling of the first hydraulic coupler assembly to the structural member. In some embodiments, a second coupler assembly (e.g., shown in FIGS. 3-7) of the type that can be removably coupled to the implement carrier 272 assembly is mounted on implement 275. The second coupler assembly has couplers that are capable of being coupled to the first coupler assembly 285 to provide signals to devices located on implement 275. Additionally, in some embodiments, the first coupler assembly 285 is so disposed and arranged in its pivotal mounting to structural member 230 such that couplers in the first coupler assembly 285 can be coupled to mating couplers on the second coupler assembly on implement 275 (when mounted on implement carrier 272) by actuating the tilt actuator 280 and rolling back the implement carrier 272 until couplers on the first coupler assembly 285 engage couplers on the second coupler assembly. For example, the engagement can be between the first coupler assembly 285 and the second coupler assembly positioned on implement carrier 272, such that using the tilt actuator to pivot the implement backward toward the power machine will position the first and second hydraulic coupler assemblies adjacent to each until they make a coupling.

In some embodiments, power machine 200 includes a release mechanism 295 configured to cause the first coupler assembly 285 to decouple from the second coupler assembly, for example, by decoupling from a second coupler assembly attached to implement carrier 272. A release actuator 297 operably coupled to the release mechanism 295 can be configured to cause the release mechanism to decouple the first coupler assembly 285 from the implement.

Figure 3:
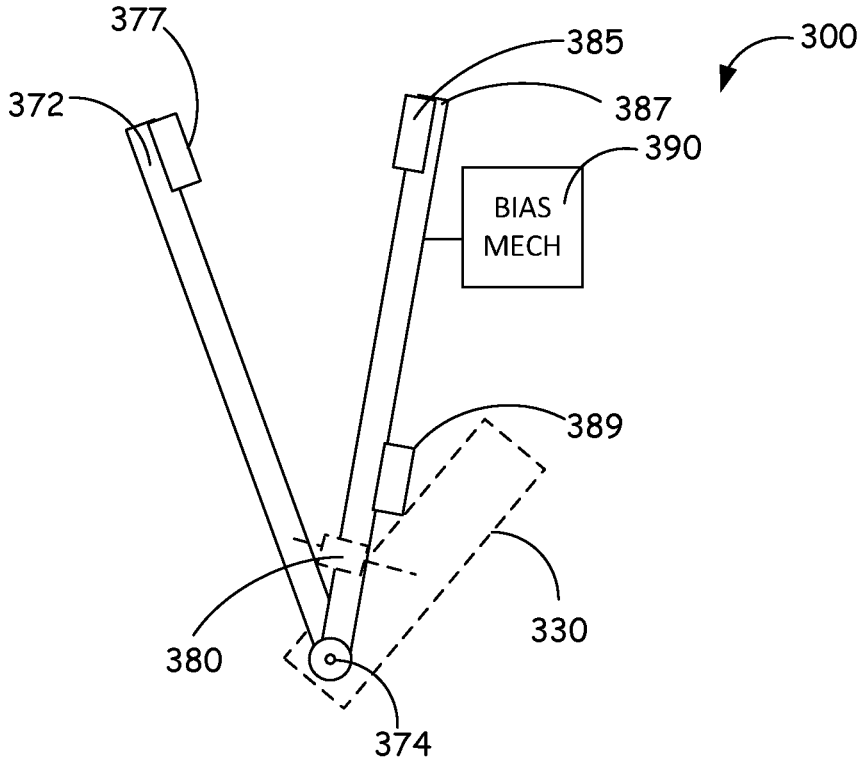
FIG. 3 is a diagrammatic illustration showing portions of a power machine in accordance with another exemplary embodiment, including a first coupling assembly pivotably coupled to a structural member and maintained in a resting position by a bias mechanism.

Referring now to FIG. 3, shown is a diagrammatic illustration of some components of an implement interface 370, which can be an embodiment of power machines 100 and 200 discussed above. As shown in FIG. 3, an implement carrier 372 is pivotably mounted about an axis 374 to a structural member 330 of the power machine and is configured to removably mount an implement to the structural member. As discussed above, structural member 330 can be, for example, a lift arm or a portion of the frame of the power machine. A tilt actuator 380 is coupled to the implement carrier and is configured to pivot the implement carrier about axis 374. In some exemplary embodiments, tilt actuator 380 is connected between implement carrier 372 and structural member 330, though other connections are possible as well.

A first, or machine side hydraulic coupler assembly 385, is also pivotably coupled to structural member 330. In the illustrated embodiment, first hydraulic coupler assembly 385 is mounted toward a distal end of a shaft 387 which pivots the first hydraulic coupler assembly 385 about axis 374. While shown pivoting relative to structural member 330 about the same axis 374 as implement carrier 372 pivots, in other embodiments, the implement carrier and first hydraulic coupler assembly 385 can pivot about axes that are offset from one another.

A biasing mechanism 390 is coupled to the first hydraulic coupler assembly 385, for example by coupling to shaft 387, and is configured to bias the first hydraulic coupler assembly 385 to a resting position (shown in FIG. 3) when the first hydraulic coupler assembly is not coupled to an implement, while allowing pivotal movement of the first hydraulic coupler assembly 385 relative to structural member 330 when the first hydraulic coupler assembly is coupled to an implement. In some exemplary embodiments, biasing mechanism 390 can be a spring, though other types of biasing mechanisms can be used as well. A stop 389 can prevent the first hydraulic coupler assembly 385 from being rotated in one direction, under the force of the biasing mechanism 390, beyond its resting position. As illustrated in FIG. 3, stop 389 can be a structure physically attached to, mounted on, or integral with structural member 330.

Figure 4:
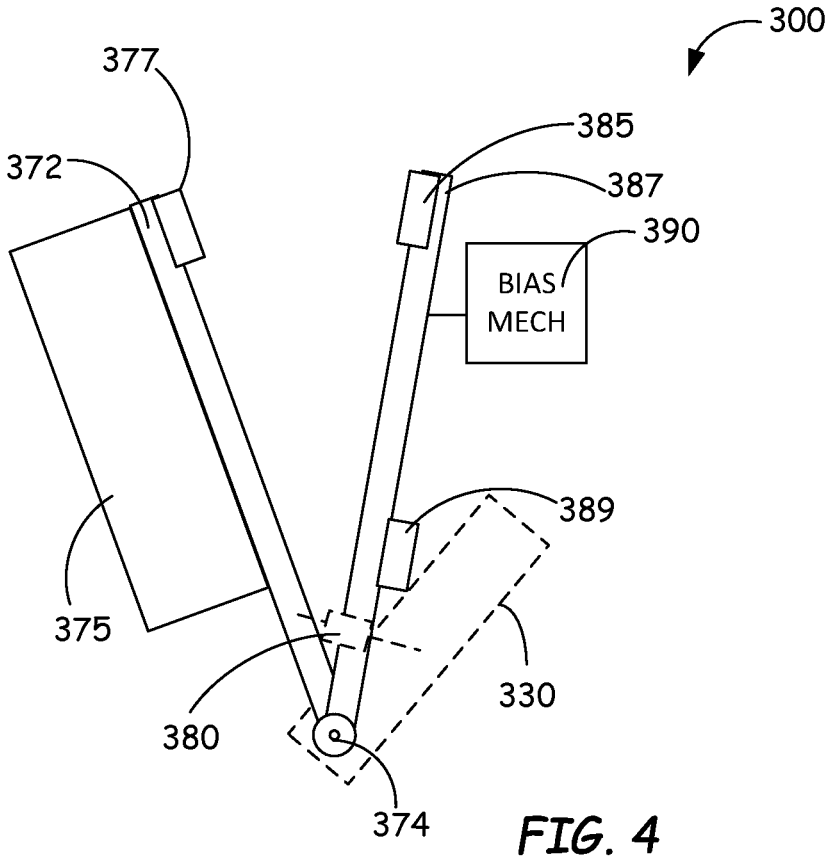
FIG. 4 is a diagrammatic illustration showing portions of the power machine as in FIG. 3 with an implement mounted on an implement carrier.

Referring now to FIG. 4, shown are the components of power machine 300 discussed above with reference to FIG. 3, but with implement 375 mounted on implement carrier 372. In addition to the first or machine side hydraulic coupler assembly 385, a second or implement side hydraulic coupler assembly 377 can be mounted on either implement carrier 372 or a structure which moves with implement carrier 372. Although not shown in order to simplify illustration of the disclosed concepts and features, with implement 375 mounted on implement carrier 372, hydraulic hoses from implement 375 are connected to second hydraulic coupler assembly 377. Similarly, hydraulic hoses from power machine 300 are connected to first hydraulic coupler assembly 385. While shown mounted on implement carrier 372, second hydraulic coupler assembly 377 can, in exemplary embodiments, be mounted such that the second hydraulic coupler assembly is positioned outside of the implement coupler interfacing surfaces in an area where the implement 375 mounts to the implement carrier 372. This allows the same implement carrier to be used on all or most similarly sized machines and does not require that the second hydraulic coupler assembly be integrated within the features of the implement carrier.

Referring now to FIG. 5, shown are the above-discussed components of power machine 300 in a state in which tilt actuator 380 has rotated or rolled back implement carrier 372 and implement 375 such that first hydraulic coupler assembly 385 and second hydraulic coupler assembly 377 have engaged or mated such that implement 375 mounted on the implement carrier 372 is hydraulically coupled to the first hydraulic coupler assembly 385 and the hydraulic system of the power machine. After engagement of first hydraulic coupler assembly 385 with second hydraulic coupler assembly 377, the first hydraulic coupler assembly can pivot (e.g., with shaft 387) relative to structural member 330 along with implement carrier 372 and implement 375. Such pivotal movement is controlled by tilt actuator 380. FIG. 6 illustrates the above-discussed components of power machine 300, with the implement carrier, implement and first hydraulic coupler pivoted relative to structural member 330, forward in a direction away from stop 389.

Figure 7:
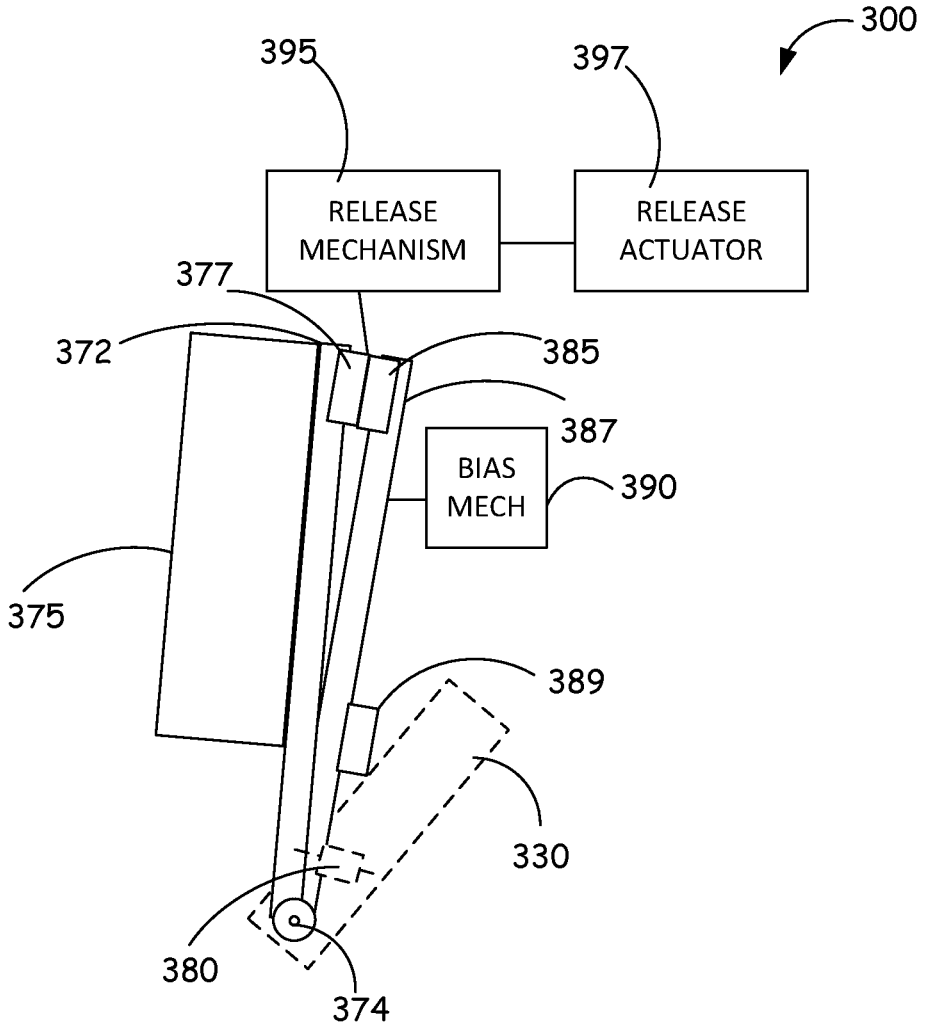
FIG. 7 is a diagrammatic illustration showing the portions of the power machine as in FIGS. 3-6, and including an optional release mechanism and release actuator, in accordance with some embodiments, which aid in decoupling the power machine and the implement.

Referring now to FIG. 7, shown is power machine 300 with additional features including a release mechanism 395 and a release actuator 397. Release mechanism 395 is configured to cause the first hydraulic coupler assembly 385 to decouple from second hydraulic coupler assembly 377 and implement 375. Release actuator 397 is coupled to the release mechanism 395 and is configured to cause the release mechanism to implement such decoupling.

Figure 8:
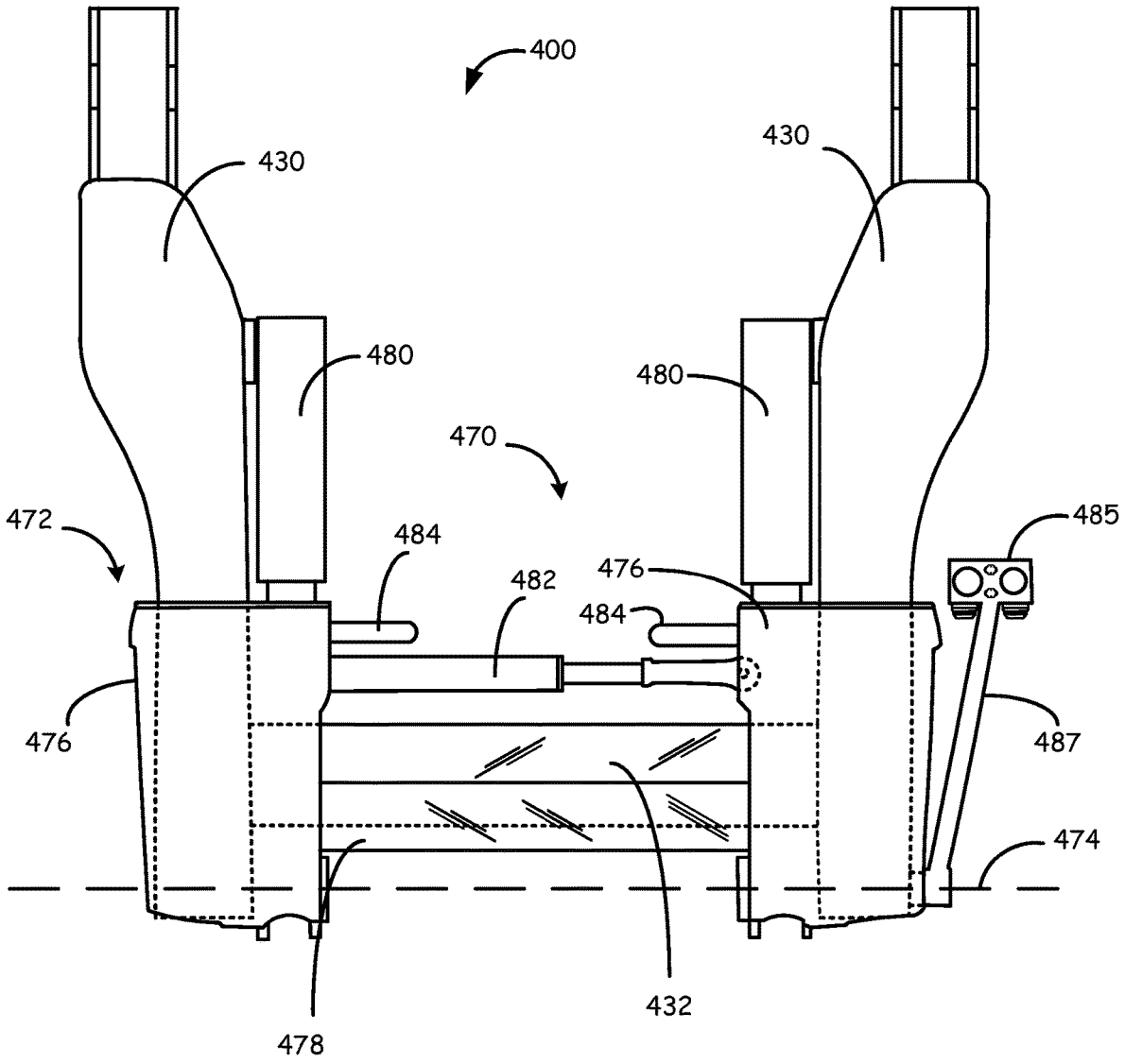
FIG. 8 is a front view illustration of a portion of a power machine in accordance with another exemplary embodiment showing a coupling assembly pivotally mounted on a lift arm and configured to pivot about a same axis as an implement carrier.

Referring now FIG. 8, shown is another embodiment of a portion of power machine 400 having features as described above. As can be seen in FIG. 8, a structural member of the power machine is provided in the form of a lift arm assembly including pair of lift arms 430 having a cross tube 432 connecting the lift arms. An implement interface 470 has an implement carrier 472 pivotally coupled toward a distal end of the lift arms and configured to pivot about an axis 474 relative to the structural member or lift arms. In this embodiment, the implement carrier 472 includes a pair of implement carrier plates 476 coupled together with a cross tube 478. The cross tube 478 is positioned forward of the cross tube 432 in FIG. 8 and partially obscures cross tube 432. A pair of tilt cylinders 480 are each coupled between one of lift arms 430 and a corresponding one of implement carrier plates 476 of implement carrier 472 to selectively rotate, under power, the implement carrier relative to the lift arm assembly. A powered locking actuator 482 controls engagement and disengagement of locking features, including levers 484, to selectively secure and release an implement (not shown in FIG. 8) coupled to the implement carrier.

Figure 9:
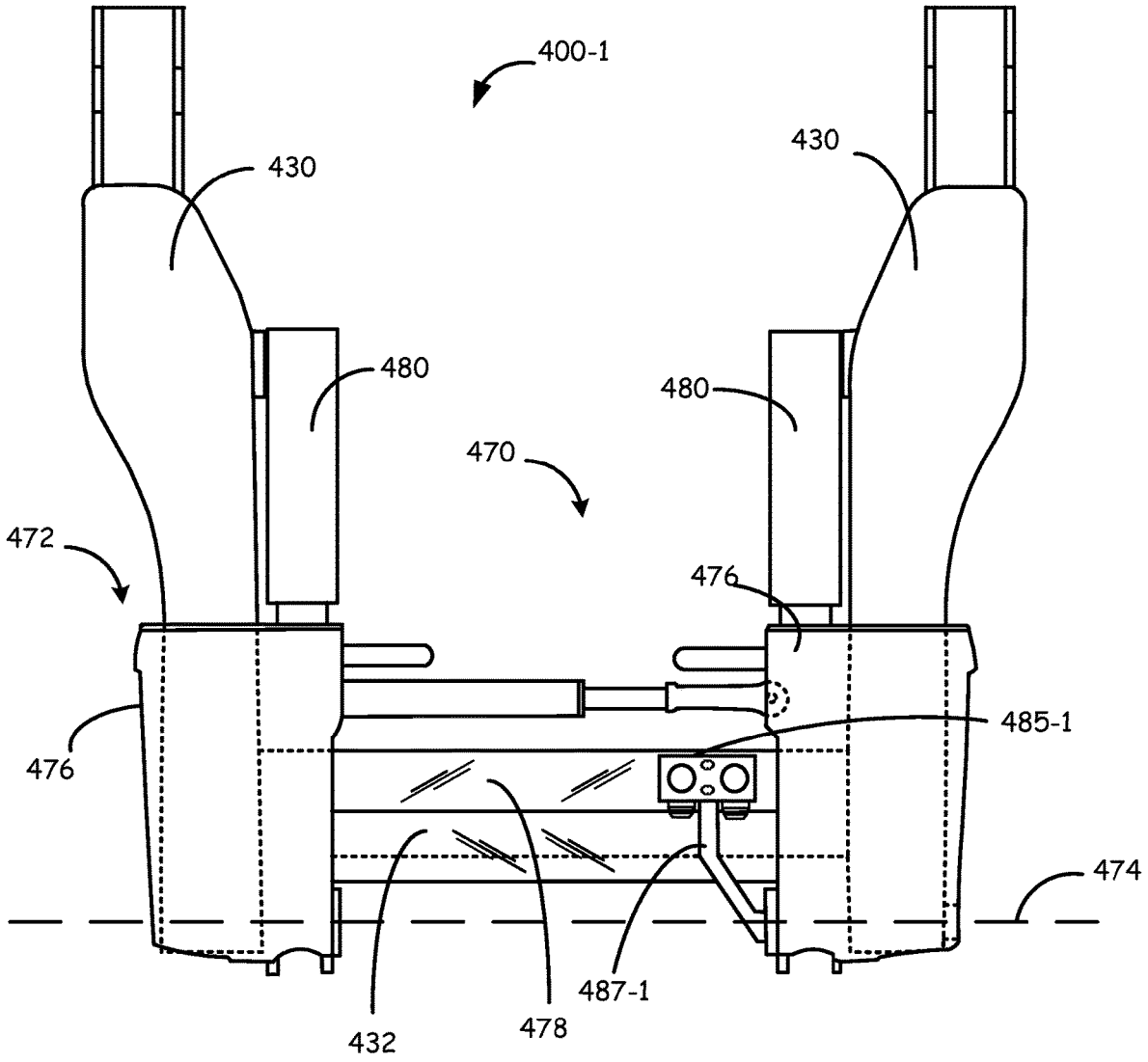
FIG. 9 is a front view illustration similar to FIG. 8 but showing an alternate coupling assembly position.

As shown in FIG. 8, a first or machine side coupler assembly 485, is pivotally mounted to lift arms 430 via a shaft 487 that is, in turn pivotally mounted to the lift arm at axis 474 such that the first coupler assembly 485 (via shaft 487) pivots or rotates relative to the lift arms about the same axis 474 as the implement carrier 472. While shaft 487 is shown in one example embodiment to position first coupler assembly 485 outside of one of lift arms 430, in other embodiments first coupler assembly 485 can be positioned between the pair of lift arms. For example, FIG. 9 illustrates an alternate embodiment of power machine 400-1 having shaft 487-1 positioning first coupler assembly 485-1 between the pair of lift arms 430. In FIGS. 8 and 9, first coupler assembly 485 can include hydraulic couplers, electrical couplers, or both hydraulic and electric couplers in various embodiments.

Figure 10:
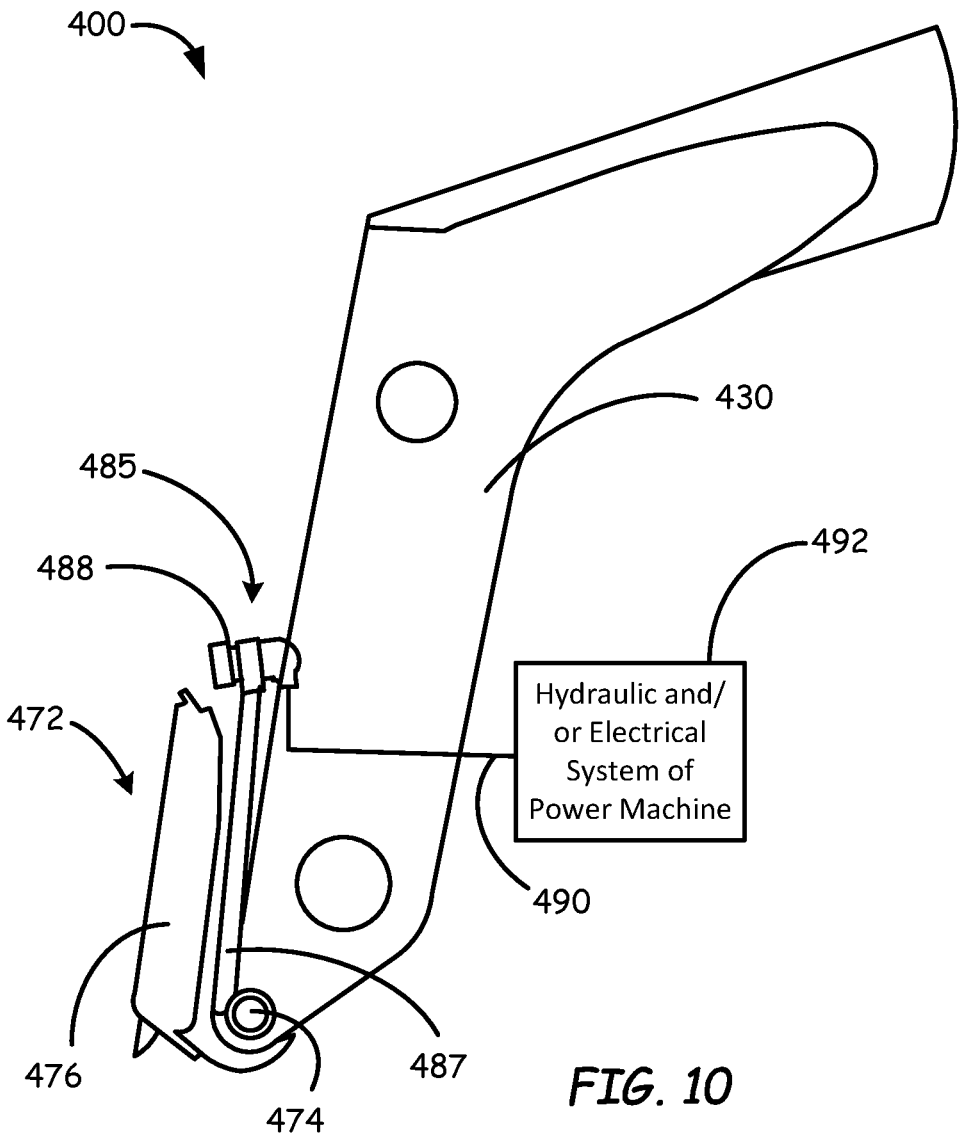
FIG. 10 is a side view illustration of the lift arm, implement carrier and coupling assembly shown in FIG. 8.

Referring now to FIG. 10, shown is a side view illustration of a portion of power machine 400 shown in FIG. 8. As discussed above, implement carrier plates 476 of implement carrier 472, as well as shaft 487 and coupler assembly 485, pivot about the same axis 474 relative to lift arms 430. As shown in this figure, coupler assembly 485 includes one or more couplers 488 configured to mate with corresponding coupler(s) on an attached implement. Each of the couplers 488 of coupler assembly 485 are connected, through hydraulic conduits or electrical connections 490 as is appropriate, to power systems 492 of the power machine. Power systems 492 can include hydraulic and/or electric systems (e.g., power source 220 and/or control system 260) of the power machine.

Figure 13:
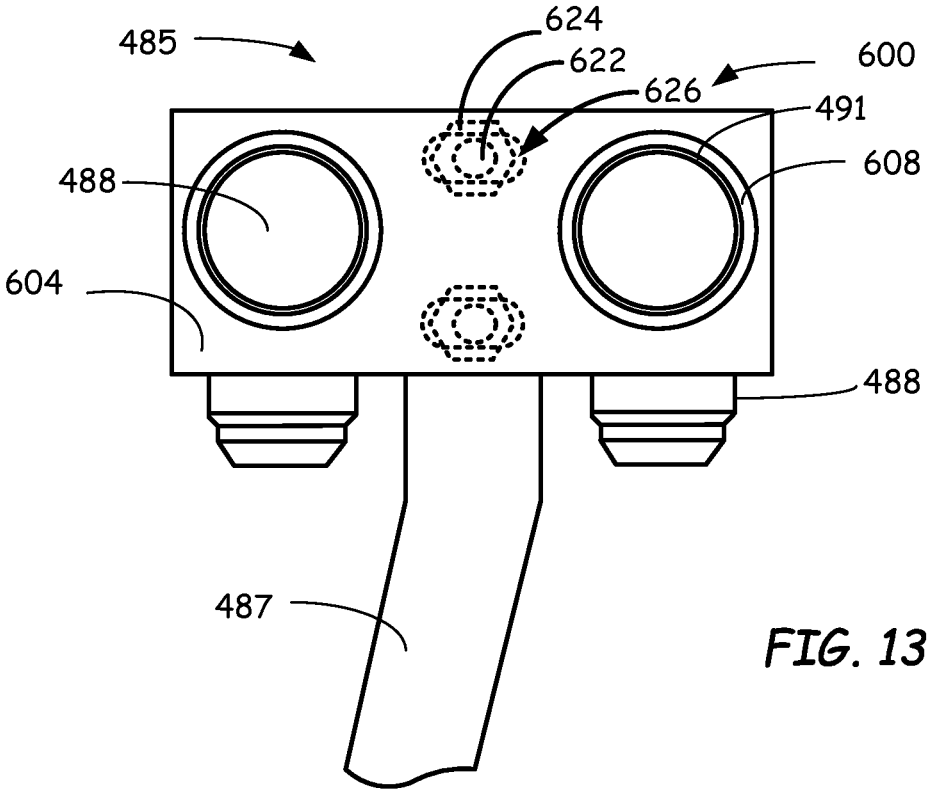
FIG. 13 is a front elevation view of the coupler assembly of FIG. 8 according to one illustrative embodiment.
Figure 14:
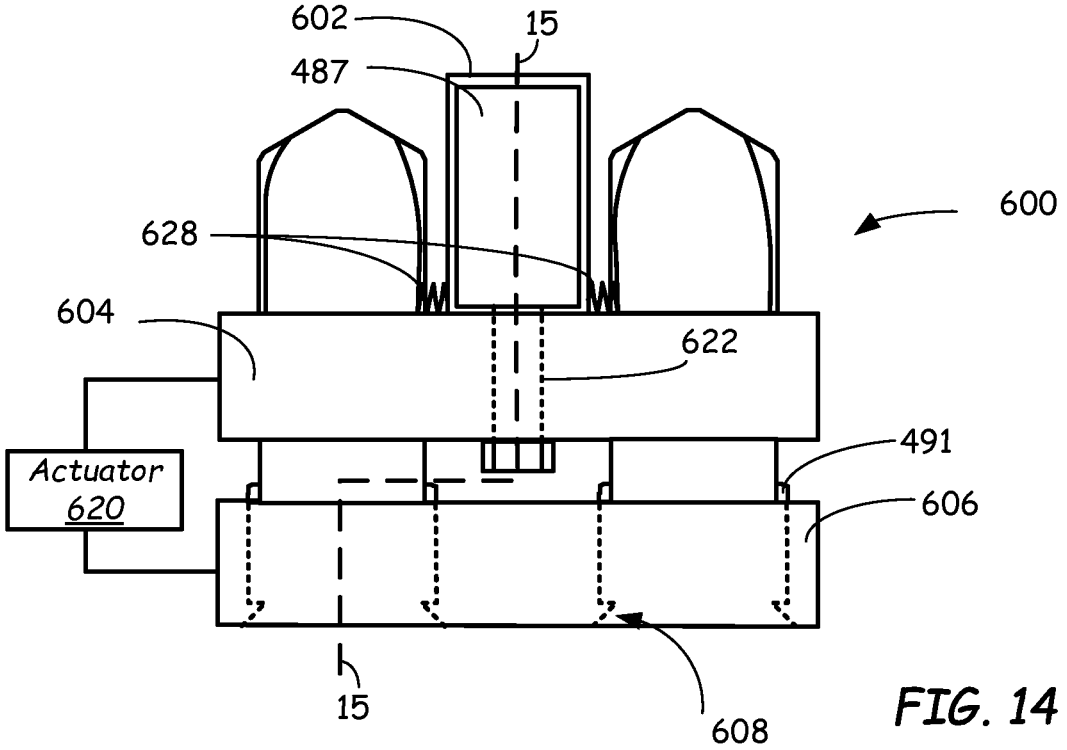
FIG. 14 is top view of the coupler assembly of FIG. 8 according to one illustrative embodiment.
Figure 15:
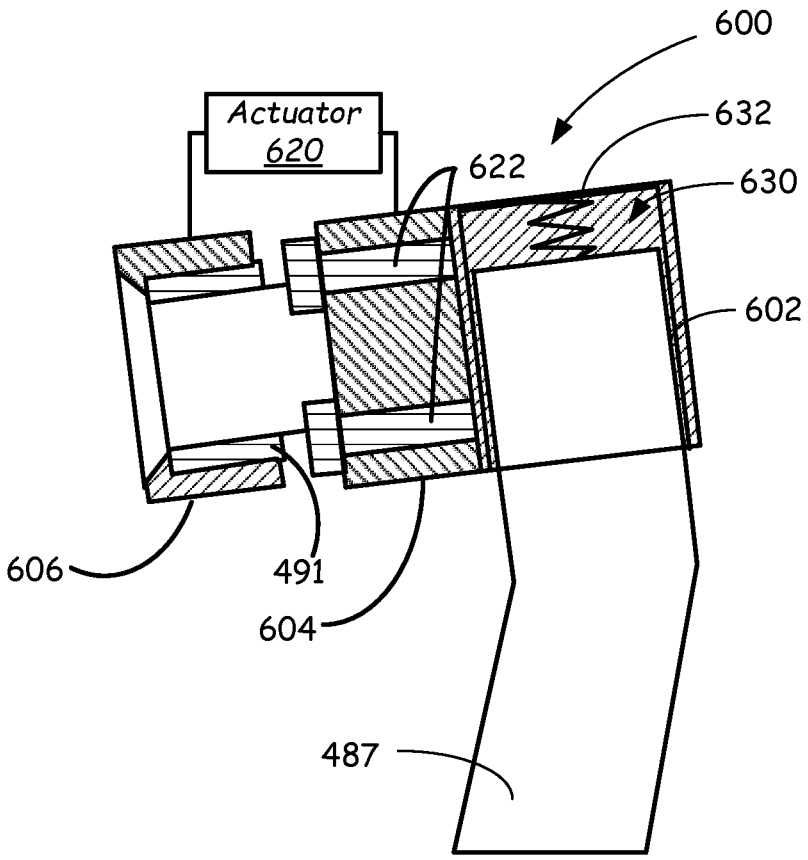
FIG. 15 is a cross-sectional view of the coupler assembly of FIG. 8 taken along a line illustrated in FIG. 14.

FIGS. 13-15 illustrate various features of the coupler assembly 485. Coupler assembly 485 includes a block structure 600 that carries couplers 488. Block structure 600 is configured to be mounted to shaft 487. In some embodiments, the block structure 600 includes a plurality of sections that are operably coupled together. A first portion 602 is coupled to the shaft 487. In some embodiments, the first portion 602 fixedly mounted to the shaft 487. In other embodiments, as is shown in FIG. 15 and is described below, the first portion 602 is movably mounted to the shaft 487. A second portion 604 of the block structure 600 is positioned adjacent to the first portion 602. The second portion 604 can be integral with the first portion 602 or fastened to the first portion 602. The second portion 604 captures and carries the couplers 488. In one embodiment, the second portion 604 can be molded, cast or otherwise formed over the couplers 488. In the embodiment shown in FIG. 13, the second portion 604 has apertures that are the same size as the outside perimeter of couplers 488 or slightly larger so that the second portion can fit right over the couplers 488 and be held in place via a friction fit. In other embodiments, the second portion 604 can be made of two or more pieces that, when assembled, clamp onto the couplers 488. In some embodiments, the second portion 604 can be fixedly attached or integral with the first portion 602. In other embodiments, as shown in FIGS. 13 and 14 and discussed in more detail below, the second portion 604 can be moveably attached to the first portion.

A third portion 606 of the block structure 600 is fitted over the couplers 488 and more particularly over a ring 491 that is fitted over each coupler 488 and is moveable with respect to the rest of the coupler. The ring 491, when moved in the direction toward the second portion 604, will cause a connection between the couplers 488 and mating couplers on an implement to break. An actuator 620 is provided between the second portion 604 and the third portion 606 that, when actuated, causes the third portion to move toward the second portion. Actuator 620 is similar to the release actuator 397 discussed above. In some embodiments, the actuator 620 is hydraulically powered, but other types of actuators can be employed. The third portion has a beveled surface 608 that engages the ring 491 on one side and provides alignment assistance for mating couplers on an implement on the other side.

As mentioned above, the second portion 604 is, in some embodiments, movable with respect to the first portion 602. As shown in FIGS. 13 and 14, a pair of fasteners 622 are provided to secure the first portion 602 to the second portion 604. In some embodiments, the fasteners 622 are studs that are fixed to first portion 602 and a nut 624 is provided to secure the second portion to the first portion. As can be seen in phantom in FIG. 13, each fastener 622 extends through a slot 626 to allow the second portion and, by extension, the couplers 488 to move laterally a small amount (limited by the length of the slot). Nut 624 is preferably a lock nut so that it will remain fastened to the stud 622 even as the second block moves against it. In other embodiments, other securing hardware can be used. This movement advantageously allows for small alignment adjustments in a horizontal direction with respect to couplers on an implement. A biasing member is provided to urge the second block into a default position. In one embodiment, a pair of springs 628 act against the couplers 488 and the first block 602 to center the second block 604. Other centering or biasing mechanisms can also be used in other embodiments.

As is mentioned above, in some embodiments, the first portion 602 of block structure 600 is movably mounted to the shaft 497. As is shown in FIG. 15, the first portion 602 has a cavity 630 sized to receive an end of the shaft 487. The cavity 630 is slightly larger than the cross-sectional area of the shaft to allow the first portion 602 to move vertically with respect to the shaft. A biasing member 632, in some embodiments as shown in FIG. 15, a spring is provided to bias the first portion in a vertical position and, illustratively, to limit overall vertical movement of the first portion 602. This feature advantageously allows for small vertical alignment adjustments with respect to couplers on an implement. It should be appreciated that although the embodiment shown in FIGS. 13-15 show both a mechanism for horizontal and vertical alignment adjustments, some embodiments may have only vertical or horizontal adjustment features or neither.

Figures 1, 11:
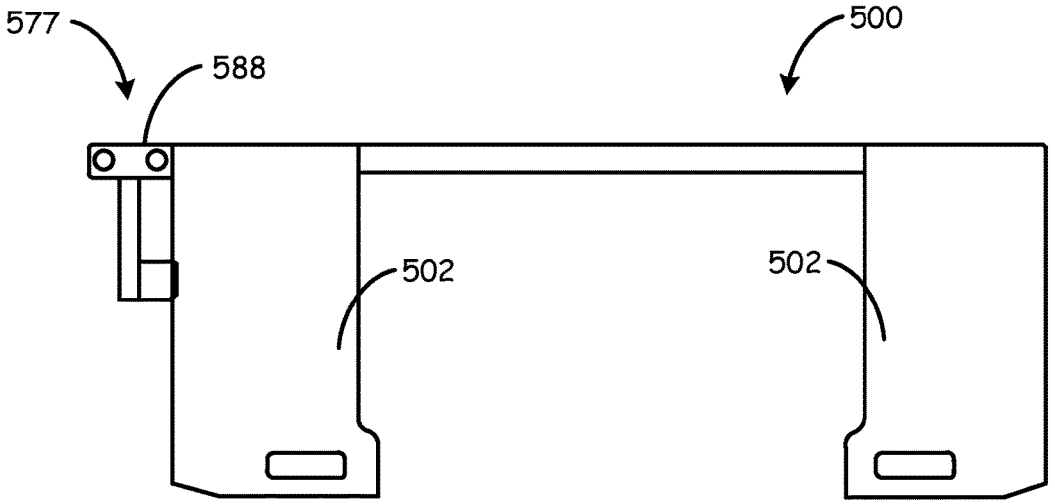
Figures 2, 11:
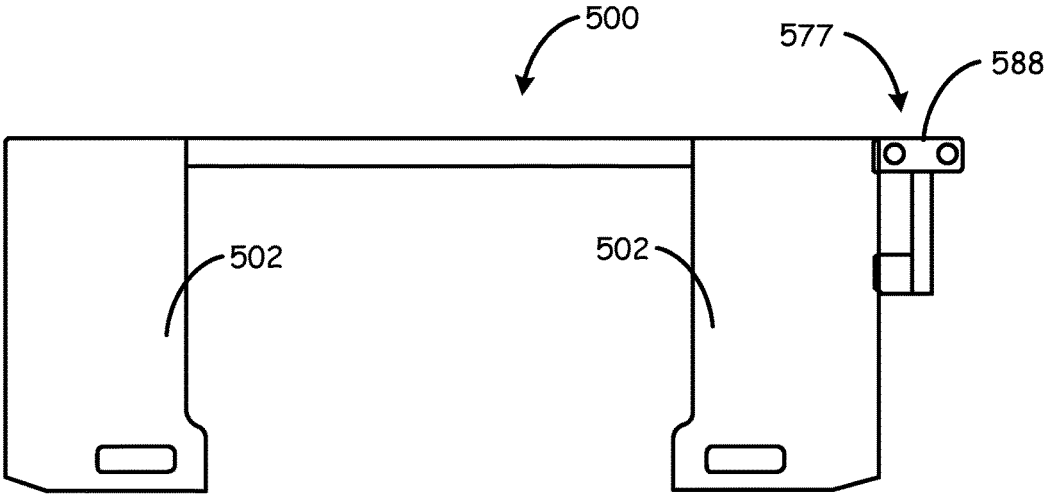
Figures 3, 11:
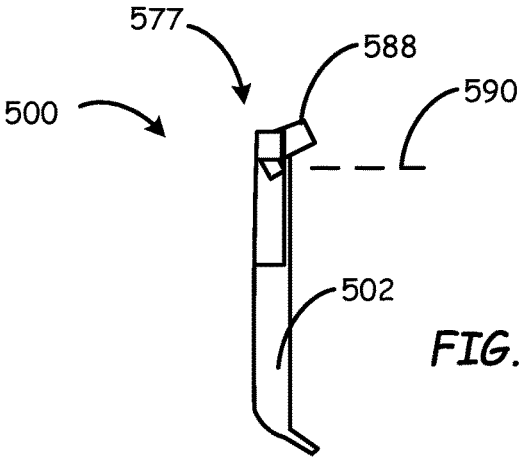
Figure 12:
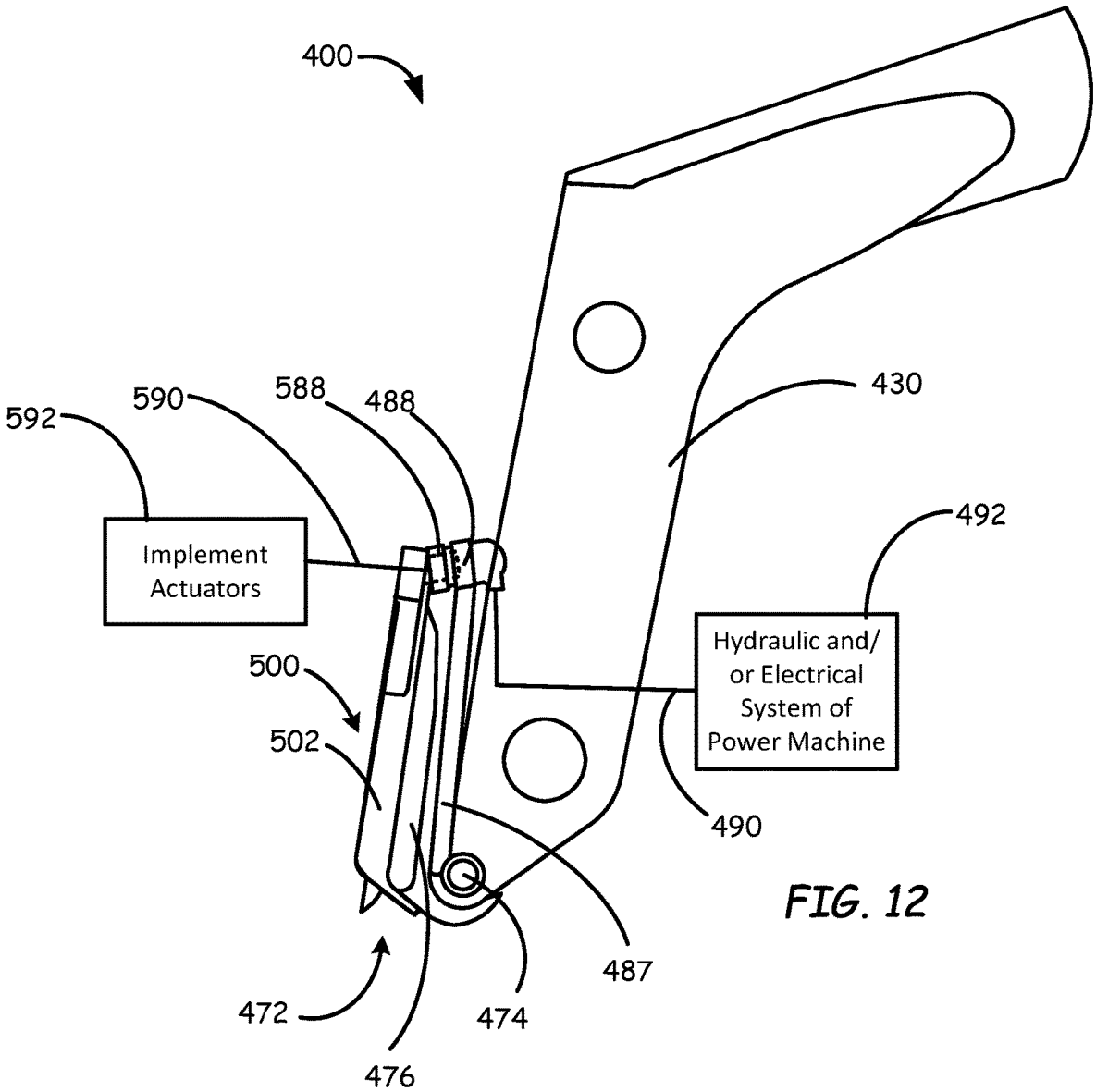
FIG. 12 is a side view illustration showing the coupling assembly of FIG. 8 coupled to an implement coupling assembly.

Referring now to FIGS. 11-1 through 11-3, shown are an implement attachment interface 500 of the type that is found on an implement (e.g., implements 275 and 375) and configured to be removably secured to implement carrier 472 of the power machine to secure the implement to the power machine. FIG. 10-1 illustrates implement attachment interface 500 as viewed from the implement carrier 472 of the power machine, while FIG. 10-2 shows the implement attachment interface side opposite that shown in FIG. 10-1, i.e., the side that is rigidly coupled to a tool portion of the implement. The side shown in FIG. 10-2 is rigidly attached to an implement (not shown). FIG. 10-3 shows the implement attachment interface 500 from a side view. Attachment interface 500 includes a pair of attachment plates 502 configured to be removably secured to the implement carrier plates 476 shown in FIG. 8. Also shown with attachment interface 500 is second coupler assembly 577 configured to mate with first coupler assembly 485. As shown in this figure, coupler assembly 577 includes one or more couplers 588 configured to mate with corresponding coupler(s) 488 discussed above. The couplers 588 of coupler assembly 577 are connected, through hydraulic hoses and/or electrical connections 590, to implement actuators 592 (e.g., hydraulic or electric elements such as motors, hydraulic cylinders, and hydraulic valves) of the implement as shown in FIG. 11. Again, the couplers and corresponding power can be hydraulic and/or electric.

As shown in FIG. 11-3, couplers 588 of second coupler assembly 577 are inclined or angled upward, relative to a direction 590 normal to plates 502. In exemplary embodiments, the inclination angle can be for example approximately 15 degrees to allow coupling of couplers 588 to couplers 488 as the implement, attachment interface 500 and implement carrier 472 follow an arc of rotation under the control of tilt actuators 480 shown in FIG. 8. Couplers 488 are similarly angled downward by approximately the same angle to facilitate the mating with couplers 588. In other embodiments, the upward and downward angling of couples 588 and 488 can be reversed.

To simplify the illustrations of aspects of disclosed embodiments, FIGS. 8-11 do not illustrate the bias mechanism (e.g., bias mechanisms 290 and 390) shown diagrammatically in FIGS. 2-7. However, these embodiments can also include such biasing mechanisms, which can be a spring or other mechanism that bias the shaft and first coupler to a resting position when the first coupler is not coupled to an implement. Similarly, FIGS. 8-11 do not separately illustrate a stop mechanism, such as stop 389 discussed above, which can be a metal tube, post or other member coupled to a lift arm 430 to prevent the coupler assembly 485 from rotating toward the structural member beyond the resting position. However, those of skill in the art will understand that the embodiments of FIGS. 8-11 can include stop mechanisms as well. Further, release mechanisms such as those discussed with reference to FIG. 2 can be included in these embodiments as well.

When an implement (not shown for illustrative purposes) is attached to the implement carrier 472, the coupling is not accomplished in some embodiments until the tilt cylinder 480 on the machine is rolled back so that the couplers of assemblies 485/577 are positioned adjacent each other and urged into engagement by the movement of the tilt cylinder 480. Once the couplers are engaged, the first or machine side coupler assembly 485 moves with the implement carrier 472 and implement as they are pivoted by movement of the tilt cylinder 480.

In some exemplary embodiments, hydraulic or electric coupling is made automatically, but without any additional actuator since the coupling is accomplished using the tilt actuator. Hydraulic coupling is also free from the process of mechanically coupling the implement to the implement carrier. Also, in exemplary embodiments, the first or machine side coupler assembly moves with the implement after a hydraulic connection is established, despite the implement couplers being removed from the implement carrier. This allows the same implement carrier to be used on all similarly sized machines. Disclosed embodiments include kits including some or all of the above discussed components so that both machines and implements can be updated in the field.

Although the present invention has been described with reference to preferred embodiments, workers skilled in the art will recognize that changes may be made in form and detail without departing from the spirit and scope of the invention.

What is claimed is:

1. A power machine configured to accept and removably secure an implement to the power machine, the power machine having a power source configured to selectively provide power to the implement, the power machine comprising:

a structural member;

an implement carrier pivotably mounted about a first axis to the structural member and configured to removably mount the implement to the structural member, the implement carrier configured to pivot about the first axis relative to the structural member; and a first coupler assembly pivotably coupled to the structural member and configured to pivot about the first axis relative to the structural member and relative to the implement carrier, one of the implement carrier and the first coupler assembly pivoting about the first axis relative to the other of the implement carrier and the first coupler assembly to couple the first coupler assembly to the implement to provide power to the implement.

2. The power machine of claim 1, and further comprising a tilt actuator, coupled to the implement carrier and configured to pivot the implement carrier about the first axis.

3. The power machine of claim 1, and further comprising:

a biasing mechanism configured to bias the first coupler assembly to a resting position when the first coupler assembly is not coupled to the implement, and allow pivotal movement of the first coupler assembly relative to the structural member when the first coupler assembly is coupled to the implement.

4. The power machine of claim 3, wherein the biasing mechanism is configured to bias the first coupler assembly away from the implement carrier.

5. The power machine of claim 4, and further comprising a stop mounted on the power machine and so disposed and arranged as to prevent the first coupler assembly from being rotated by the biasing mechanism beyond the resting position.

6. The power machine of claim 1, wherein the structural member comprises a lift arm of the power machine.

7. The power machine of claim 6, wherein the structural member comprises a pair of lift arms and wherein the first coupler assembly is positioned outside of one of the pair of lift arms.

8. The power machine of claim 6, wherein the structural member comprises a pair of lift arms and wherein the first coupler assembly is positioned between the pair of lift arms.

9. The power machine of claim 1, wherein the structural member comprises a frame of the power machine.

10. The power machine of claim 1, wherein the first coupler assembly is pivotally mounted to the structural member and so disposed and arranged such that the implement mounted on the implement carrier is coupled to the first coupler assembly to receive power from the power machine by actuating a tilt actuator and rolling back the implement carrier until the implement engages the first coupler assembly.

11. The power machine of claim 1, wherein the first coupler assembly is a hydraulic coupler assembly providing hydraulic fluid under power to the implement.

12. The power machine of claim 1, wherein the first coupler assembly is an electric coupler assembly providing electric power to the implement.

13. The power machine of claim 1, and further comprising a first mounting member having the first coupler assembly mounted thereon and being pivotably coupled to the structural member to provide the pivotable coupling of the first coupler assembly to the structural member.

14. The power machine of claim 1, and further comprising a second coupler assembly coupled to the implement carrier.

15. The power machine of claim 1, and further comprising a release mechanism configured to cause the first coupler assembly to decouple from the implement.

16. The power machine of claim 15, and further comprising a release actuator operably coupled to the release mechanism and configured to cause the release mechanism to decouple the first coupler assembly from the implement.

17. The power machine of claim 13, wherein the first coupler assembly includes a first block mounted on the first mounting member.

18. The power machine of claim 17, wherein the first block is movably mounted to the first mounting member.

19. The power machine of claim 17, wherein the first coupler assembly includes a second block 604 that is coupled to the first block.

20. The power machine of claim 19, wherein second block is moveably mounted to the first block.

21. A method of coupling a power supply on a power machine to an implement, comprising:

mounting the implement on an implement carrier that is pivotably attached to the power machine and configured to pivot about a first axis relative to the power machine; and actuating a tilt actuator of the power machine to rotate the implement carrier and mounted implement about the first axis until an implement coupler engages a machine coupler, the machine coupler being pivotally attached to a structure on the power machine such that the machine coupler is configured to pivot about the first axis relative to the structure of the power machine and the implement carrier and such that the machine coupler is biased to a resting position.

22. The method of claim 21, wherein mounting the implement on the implement carrier further comprise mounting the implement on the implement carrier that is pivotably attached to the structure on the power machine.

23. The method of claim 22, wherein the structure on the power machine is a lift arm, and wherein mounting the implement on the implement carrier further comprise mounting the implement on the implement carrier that is pivotably attached to the lift arm of the power machine.

24. The method of claim 23, wherein the structure on the power machine is a frame of the power machine, and wherein mounting the implement on the implement carrier further comprise mounting the implement on the implement carrier that is pivotably attached to the frame of the power machine.

* * * * *